US009651269B2

(12) United States Patent
Bronicki

(10) Patent No.: US 9,651,269 B2
(45) Date of Patent: May 16, 2017

(54) DEVICE AND METHOD FOR MINIMIZING THE EFFECT OF AMBIENT CONDITIONS ON THE OPERATION OF A HEAT EXCHANGER

(75) Inventor: Lucien Y. Bronicki, Yavne (IL)

(73) Assignee: Ormat Technologies Inc., Reno, NV (US)

( * ) Notice: Subject to any disclaimer, the term of this patent is extended or adjusted under 35 U.S.C. 154(b) by 965 days.

(21) Appl. No.: 13/614,689

(22) Filed: Sep. 13, 2012

(65) Prior Publication Data

US 2014/0000863 A1 Jan. 2, 2014

Related U.S. Application Data

(60) Provisional application No. 61/667,184, filed on Jul. 2, 2012.

(51) Int. Cl.

| | |
|---|---|
| ***G05D 23/00*** | (2006.01) |
| ***F24F 1/48*** | (2011.01) |
| ***F28F 13/12*** | (2006.01) |
| ***F28F 27/00*** | (2006.01) |
| ***F28B 1/06*** | (2006.01) |

(52) U.S. Cl.

CPC ..... *F24F 1/48* (2013.01); *F28B 1/06* (2013.01); *F28F 13/12* (2013.01); *F28F 27/00* (2013.01); *F28F 2250/00* (2013.01); *F28F 2265/02* (2013.01)

(58) Field of Classification Search

CPC ..... F24F 1/48; F28B 1/06; F28B 1/08; F28F 13/10; F28F 13/12; F28F 27/00; F28F 27/003; F28F 2250/00; F28F 2265/02; F28F 2011/0039; F28F 2011/0042

USPC ..... 165/287, 121, 295, 47, 53, 96, 99, 122, 165/127, 900; 454/347, 352, 358, 242, 454/244, 9, 17, 20, 21, 24, 25

See application file for complete search history.

(56) References Cited

U.S. PATENT DOCUMENTS

| | | | | |
|---|---|---|---|---|
| 3,933,196 | A | 1/1976 | Heller et al. | |
| 4,217,317 | A * | 8/1980 | Neu | F28B 1/06 165/900 |
| 4,450,899 | A | 5/1984 | Jakobsson et al. | |
| 7,431,270 | B2 | 10/2008 | Mockry et al. | |
| 2008/0196435 | A1 | 8/2008 | Schulze | |
| 2010/0172089 | A1 | 7/2010 | Chiu et al. | |

(Continued)

FOREIGN PATENT DOCUMENTS

| | | |
|---|---|---|
| GB | 948562 | 2/1964 |

OTHER PUBLICATIONS

U.S. Appl. No. 14/322,458, filed Jul. 2, 2014, Bronicki, et al.

(Continued)

*Primary Examiner* — Travis Ruby

(74) *Attorney, Agent, or Firm* — Oblon, McClelland, Maier & Neustadt, L.L.P.

(57) ABSTRACT

A method of minimizing the effect of wind on a heat exchanger system includes setting the pivot angle of a wind deflector to an initial angle; collecting and recording a current reading of one of an outlet temperature sensor, a wind speed sensor, an ambient temperature sensor, or a heat exchanger inlet air pressure sensor; comparing the current reading of the sensor to a previous reading; and changing the pivot angle of the wind deflector from an initial angle when the current sensor reading is changed from the previous reading.

6 Claims, 7 Drawing Sheets

(56) References Cited

U.S. PATENT DOCUMENTS

| | | | |
|---|---|---|---|
| 2012/0036873 | A1 | 2/2012 | Bush |
| 2012/0118513 | A1 | 5/2012 | Melhuish et al. |

OTHER PUBLICATIONS

U.S. Appl. No. 14/323,588, filed Jul. 3, 2014, Bronicki, et al.
International Search Report issued Dec. 12, 2013, in PCT/IB13/01393.

* cited by examiner

SIMULATION DATA

AMBIENT TEMPERATURE: 10°C

CONDENSER PRESSURE: 70PA

PLANT ALTITUDE: 1210 M

ACC HEIGHT: 20' AND 40'

SIMULATION CONDITIONS:

FRONTAL VELOCITIES RANGE: 0 TO 14 M/S

CROSS FLOW VELOCITIES RANGE: 0 TO 14 M/S

CROSS FLOW AT ANGLES: 30, 45 AND 60

AT VELOCITIES: 3 AND 6 M/S

DEVICE AND METHOD FOR MINIMIZING THE EFFECT OF AMBIENT CONDITIONS ON THE OPERATION OF A HEAT EXCHANGER

TECHNICAL FIELD

The present invention relates to heat exchangers and more particularly to a device and for minimizing the effect of ambient conditions on the operation of a heat exchanger.

BACKGROUND

Heat exchangers are commonly used where heat produced a plant or a machine needs to be transferred away from the plant or machine. One very common type of heat exchanger uses one or more heat exchanging arrays each comprising a plurality of fluid conduits or tubes surrounded with fins (finned tubes) and arranged so that cooling fluid, such as air, water and the like (coolant), can flow over the tubes and dissipate their thermal energy. When a large amount of heat needs to be removed, the heat exchanger will typically be located outdoors. Some large heat exchangers are built to be cooled by air and are installed so that the desired flow of air through the heat exchanger is from the bottom up. In order to increase the rate of heat dissipation, fans can be installed above the heat exchanger to induce the flow of air from the bottom up through the heat exchanger. When cooling fluid flows through the heat exchanger, the mode of dissipation is convection. When the flow of coolant is stopped, the heat dissipation will be carried out mostly in a radiation mode which is much less efficient compared to the convection mode. Very large heat exchangers are typically arranged in a horizontal very long rectangle (ratio of length to width being very high). FIG. 1A shows heat exchanger 2 as is known in the art. Heat exchanger 2 may comprise finned tube section 4 and plurality of fans 6. Heat exchanger 2 has length L, width W and height H. Heat exchanger 2 is typically installed above the level of ground at a distance FH from the ground to allow free flow of air underneath the heat exchanger.

The efficiency of heat dissipation of such heat exchangers depends on various ambient conditions and changes therein, such as the amount of exposure to direct sun light, the ambient temperature and the actual wind (direction and magnitude) at the heat exchanger location. For large heat exchangers with a high aspect ratio (L/W) figure, wind blowing parallel to its length dimension has a negligible effect. In contrast, wind blowing parallel to its width dimension may have a substantial effect.

With strong enough winds flowing over a heat exchanger parallel to its width dimension, the flow of coolant air through the heat exchanger may be disturbed and even completely blocked, as can be seen in FIGS. 1B and 1C, schematically depicting cross section 10 in heat exchanger 2 partially along cross section line AA, showing only one fan and its finned tube section 11 [section plane SF(P)]. The air flow through heat exchanger 10 when no wind blows can be seen from FIG. 1B while the air flow through heat exchanger 10 when wind blows from right to left can be seen from FIG. 1C. As may be seen, when no wind blows over heat exchanger 10, the air flow produced by fans 12, through finned tubes section 11, is undisturbed and evenly distributed across the exchanger from right to left. However, when wind blows across heat exchanger 10, as seen in FIG. 1C, the coolant flow through the portion of exchanger 10 that is close to the wind side is disturbed. FIG. 1D is a graph depicting the amount of air flow through each one of three fans F1, F2 and F3 ordered in row 20 in an array across the width dimension of a heat exchanger such as heat exchanger 2 (FIG. 1A). F1 is the fan closest to the wind side. The graph of FIG. 1D presents the amount of mass of air, [kg/Sec], (Y axis) flowing through each fan as a function of the wind speed [m/sec] (X axis) blowing parallel to the width dimension. While the changes in mass flow through F3, which is farthest from the wind side, as function of the wind speed, are negligible, the mass flow through F1, the fan closest to the wind side drops down sharply with the wind speed and equals to half its maximum at 45 m/sec. (about 160 km/h) and to zero at wind speed of 70 in/sec. (about 250 km/h). FIG. 1E represents the temperature distribution in the air above fans F1, F2 and F3 when strong wind blows over the heat exchanger from right to left. It can be seen that the air above fan F1 reaches only the lowest temperature, meaning that the capability of F1 to remove heat is minimal. As opposed to fan F1, above fan F3, the fan farthest from the side of the wind, there is a high column of air with the highest temperature, indicative of high capability of heat dissipation. Note that temperatures of the heat exchanger itself are not reflected in this drawing.

There is a need for a solution that will minimize the dependency of the operation of a heat exchanger of the known art on the wind.

SUMMARY

A heat exchanger system for cooling liquid having a plurality of finned tube arrays and a plurality of fans for inducing air through the finned tube array comprising: at least one wind deflector installed along the long side of the finned tube arrays on at least one side of the arrays.

The present invention for comprises a method for minimizing the undesired effect of wind on the operation of a heat exchanger system for cooling liquid having a plurality of finned tube arrays and a plurality of fans for inducing air through the finned tube array, said method comprising the steps of:

a. setting the angle of deflection of the wind deflectors other than the angle of deflection of the uppermost position of said wind deflectors;
b. collecting readings of outlet temperature sensor of said heat exchanger, ambient temperature, wind sensor and inlet air pressure sensor of said heat exchanger;
c. recording readings of outlet temperature sensor of said heat exchanger, ambient temperature, wind sensor and inlet air pressure sensor of said heat exchanger;
d. comparing readings of outlet temperature sensor of said heat exchanger, ambient temperature, wind sensor and inlet air pressure sensor of said heat exchanger to previous readings; and
e. carrying out a correction command if the said readings have changed.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
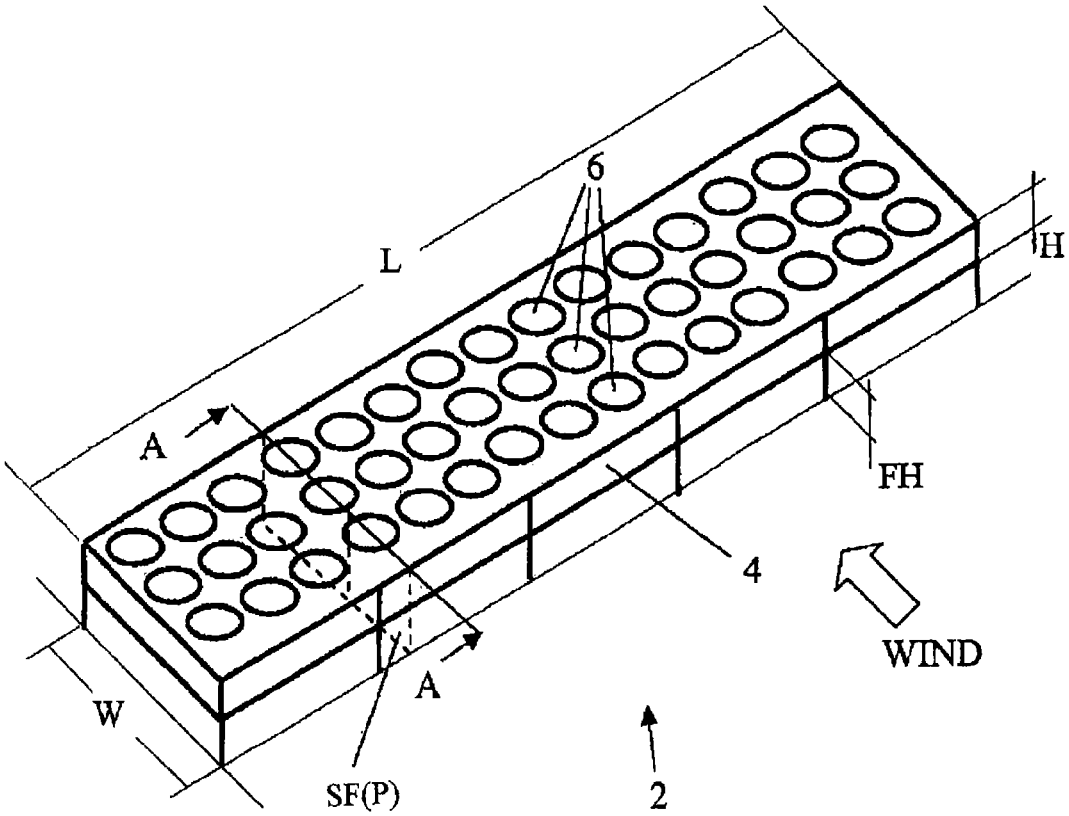
FIG. 1A PRIOR ART
FIG. 1A depicts heat exchanger as is known in the art.
Figures 1B, 1C:
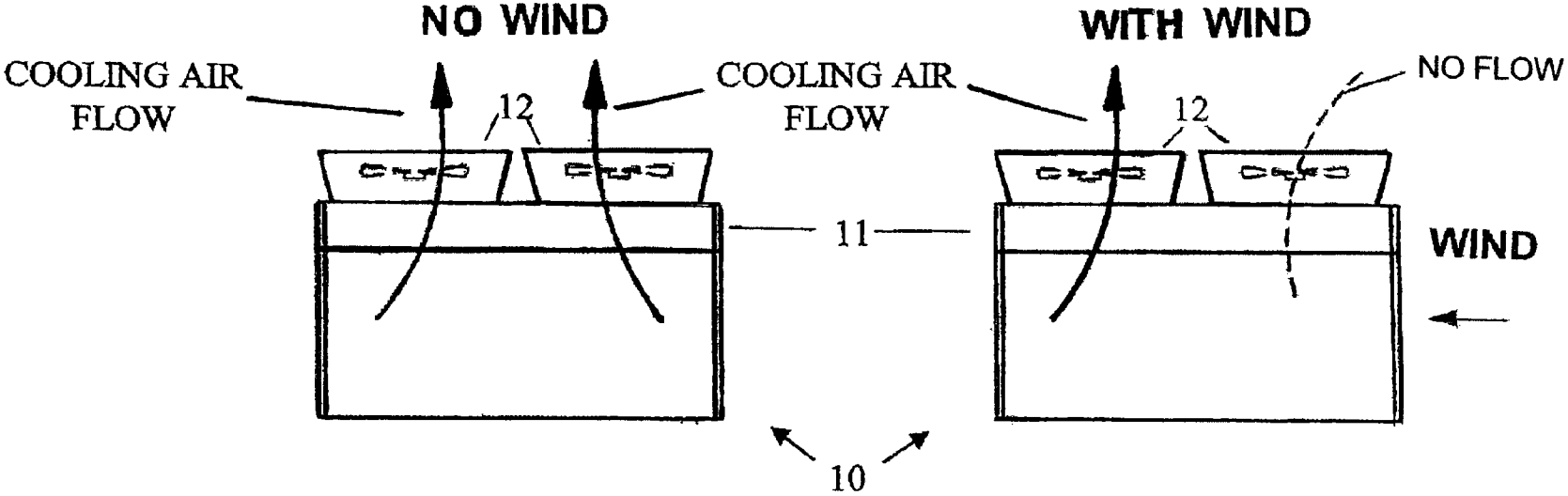
FIG. 1C PRIOR ART
FIGS. 1B and 1C schematically depict cross section in heat exchanger.
Figure 1D:
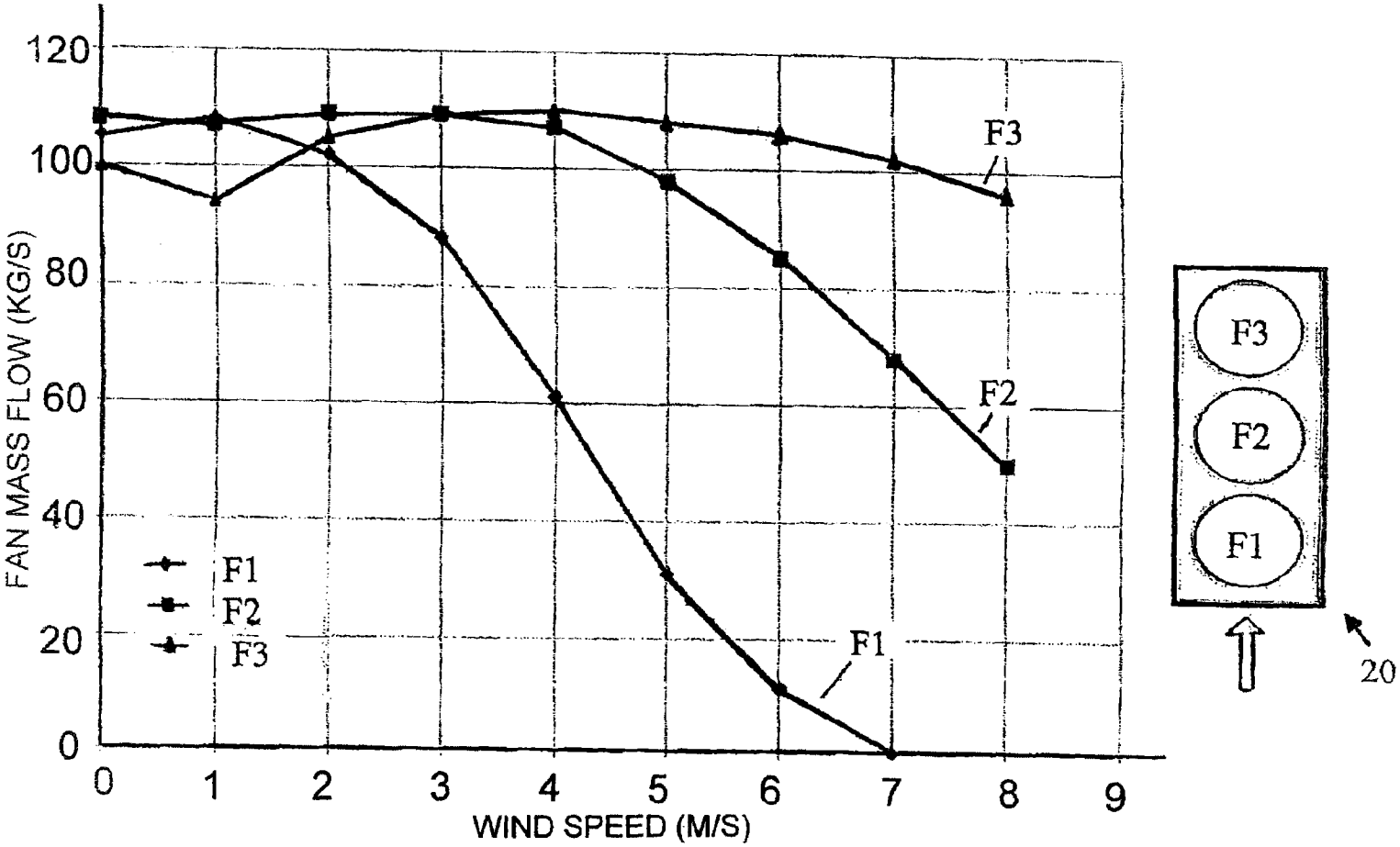
FIG. 1D PRIOR ART
FIG. 1D is a graph depicting the amount of air flow through each one of three fans in a row in an array across the width dimension of a heat exchanger.
Figure 1E:
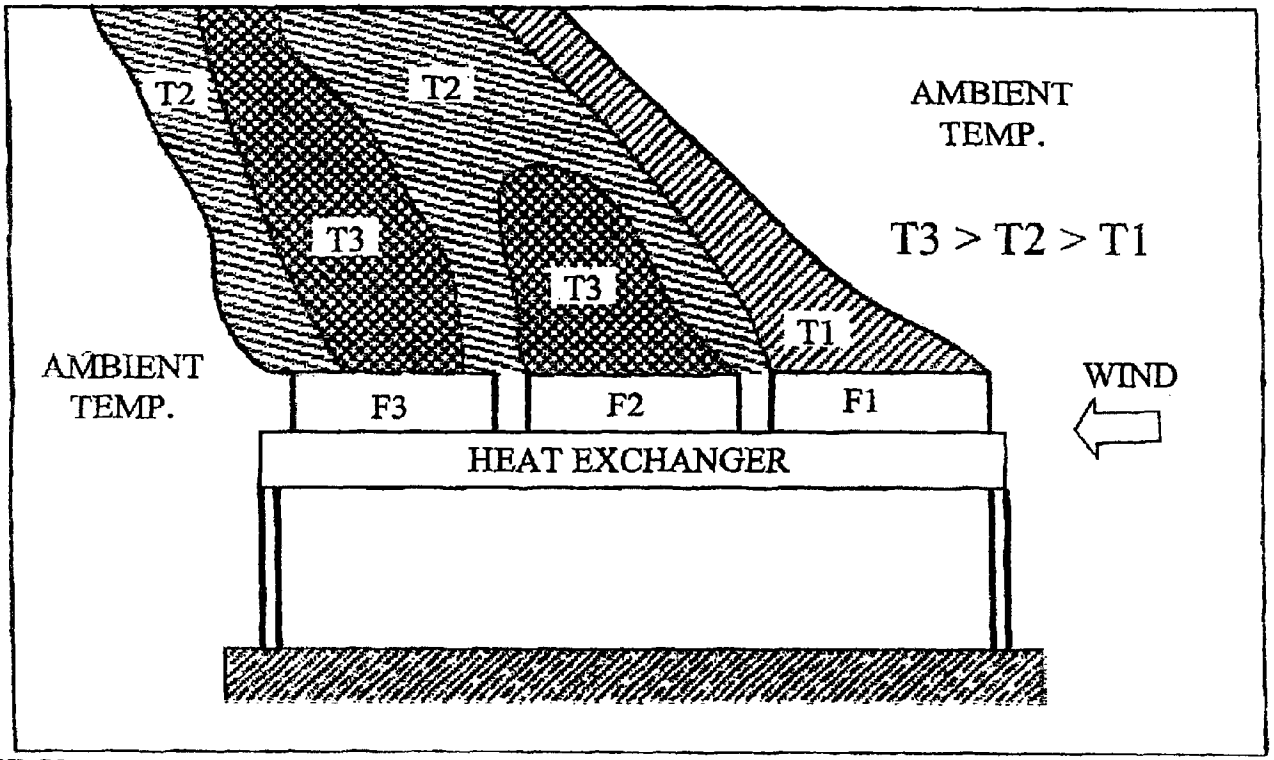
FIG. 1E PRIOR ART
FIG. 1E represents the temperature distribution in the air above three fans when strong wind blows over the heat exchanger.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

A heat exchanger is disclosed, according to embodiments of the present invention, equipped with one or more wind deflectors, to affect the flow of air under finned tube sections of a heat exchanger so as to minimize, and even completely cancel that undesired effect of the blowing wind.

Figure 2:
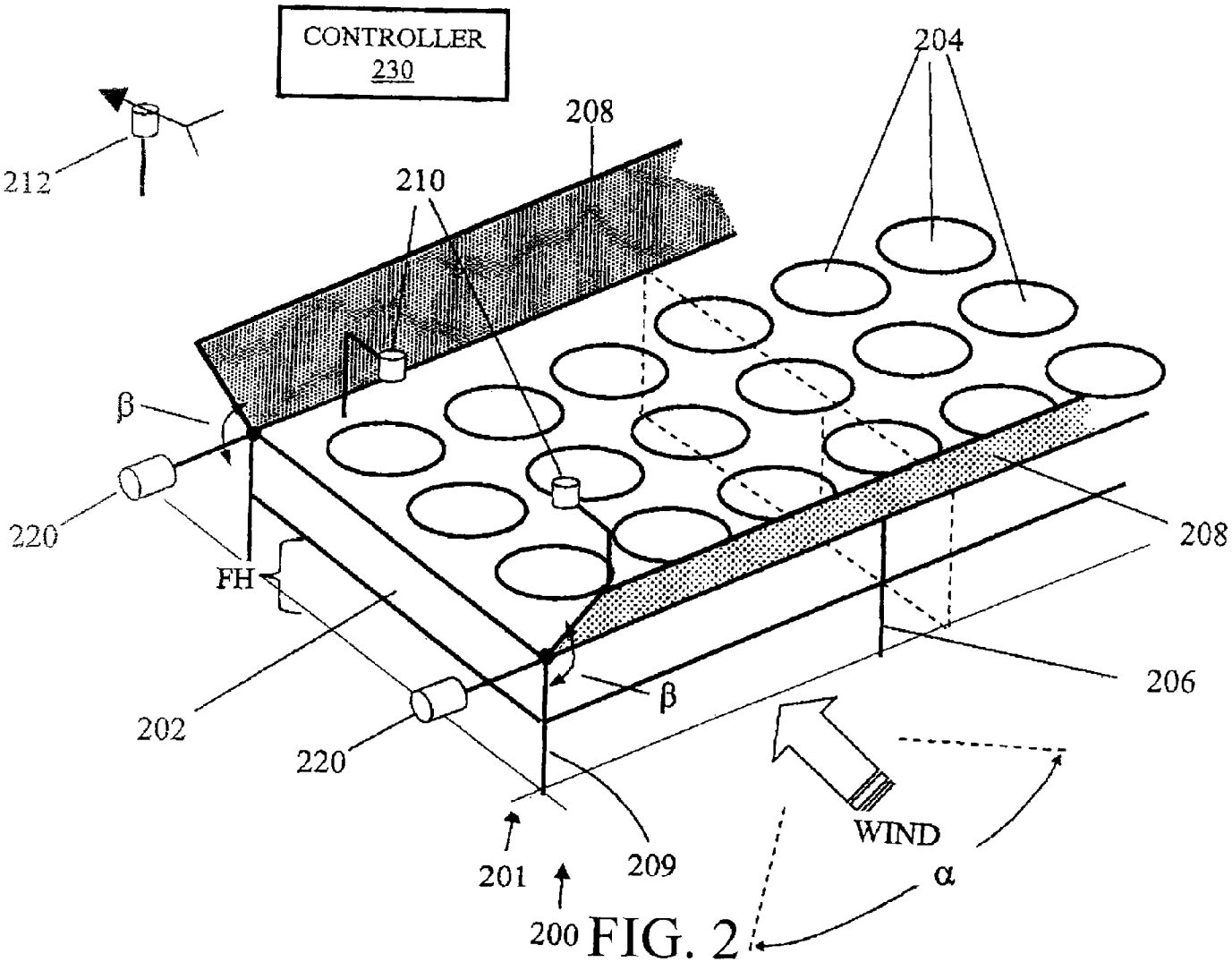
FIG. 2 depicts a system for minimizing ambient effect on the operation of heat exchanger according to embodiments of the present invention.

Reference is made now to FIG. 2, depicting system 200 for minimizing ambient effect on the operation of heat exchanger 201 according to embodiments of the present invention. Heat exchanger 201 can comprise a plurality of finned tube arrays 202 equipped with a plurality of fans 204 adapted to induce air through finned tube arrays 202. The plurality of finned tube arrays 202 and plurality of fans 204 are installed so that their width dimension W and length dimension L form a plane that is essentially horizontal. The finned tube arrays 202 are installed above the ground/floor by FH to allow free flow of air under finned tube arrays 202. System 200 may further comprise a plurality of wind deflectors 208, installed along the long sides of the finned tube arrays on both sides of the arrays. Wind deflectors 208 are installed pivotally on finned tubes arrays 202 so as to allow wind deflectors 208 to change the angle β between wind deflector 208 and support legs 209 of finned tubes arrays between 0 degrees and essentially 180 degrees.

Wind deflectors 208 can be driven by actuators 220 to control their actual deflection angle β. Actuators 220 may be an electrical motor, a hydraulic motor, a pneumatic motor or any other control that may change the deflection angle β in a controllable manner. According to some embodiments of the present invention, actuator 220 can comprise, or be coupled to, an angle indicator (not shown) or other indicator, such as a shaft encoder, either absolute or relative, to provide indication of the actual angle β of wind deflectors 208.

System 200 may further comprise temperature sensors 210 located at the outlet of some of fans 204, advantageously sensing the temperature of the air at the outlet of pairs of fans 204 located in the same row (a row being parallel to the width dimension) at the outer ends of the row and, each, next to a respective edge of finned tube arrays 202. System 200 may further comprise ambient conditions sensor 212, which may comprise temperature sensor, wind direction and speed sensor, and the like. Ambient conditions sensor 212 should preferably be located far enough from heat exchanger 201, to avoid influence of the activity of heat exchanger 201 on the operation of ambient sensor 212.

Some embodiments of system 200 may further comprise one or more pressure sensors located under finned tubes arrays 202 (see in FIG. 3A, units 318), used to sense the pressure near the entry of cooling air into heat exchanger 201. The pressure sensors may be adapted to sense static pressure, dynamic pressure or both. Indication received from these sensors may be meaningful for identifying development of conditions leading to turbulent flow of the cooling air, while it is apparent that the heat dissipation of heat exchanger 201 grows when the cooling air flow is laminar.

System 200 further comprise controller 230 to receive readings from the various sensors and to control the actual deflection angles β of wind deflectors 208. Controller 230 may be a computer, a controller, a programmable logic controller (PLC) and the like. Controller 230 may comprise an input/output (I/O) unit, a non-transitory memory storage unit to store programs, data and tables of stored variables and communication interface unit to allow communication with other controllers and/or with a control center.

The control of the actual deflection angles β of wind deflectors 208 may be responsive to changes in one or more of the various measured parameters received from the various sensors, as presented, for example, in the following chart.

| | Parameter | Effect on Deflection Angle |
|---|---|---|
| 1 | Wind direction within limits of angle α | Control system active |
| 2 | Wind direction is out of limits of angle α and/or wind speed is close to zero | Control system inactive; wind deflectors are placed in their uppermost position (β = 150-180 degrees) |
| 3 | Temperature difference ΔT1 between a pair of temperature sensors (210) is growing | Decrease angle β of the wind deflector close to the temperature sensor sensing lower temperature, and vice versa |
| 4 | Ambient wind speed growing | Expect need to decrease angle β of wind deflector located on the side of heat exchanger farther from the wind side, and vice versa |
| 5 | Static pressure at pressure sensors 318 decreases | Decrease angle β of wind deflector closer to the pressure sensor sensed decrease of static pressure |

It would be appreciated by one skilled in the art that additional reading of process parameters may be relied upon in order to achieve accurate, smooth and fast—response control of the wind deflectors, such as temperature of the cooled fluid in heat exchanger 202 at the entrance into the exchanger and at the outlet, indicating over all heat dissipation efficiency.

The control function performed by controller 230 may be rule-based, relying on a series of logical and/or continuous connections between parameters as presented, for example, in the table above. The control operation of the actual angle of deflection of wind deflectors 208 may utilize control tools and facilities known in the art, such as a proportional-integral-derivative (PID) control loop to provide a fast responding and stabilized control loop. In other embodiments, the control operation may be simpler (and thus cheaper) and utilize bang-bang control loop (control system that changes its working point between two edge points and changes the working point based on the control feedback, stabilizing around duty cycle that satisfies the control equation).

Figure 3A:
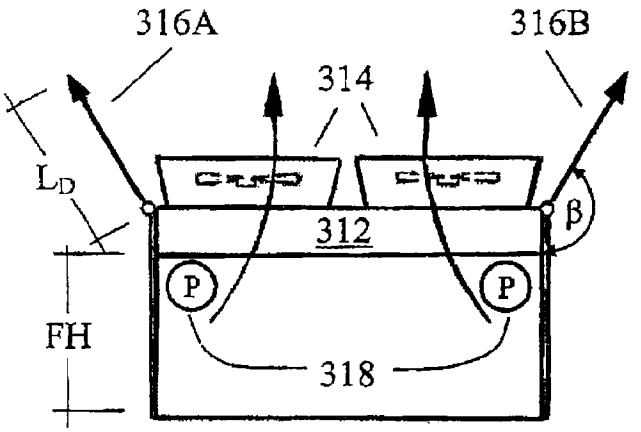
FIGS. 3A, 3B, 3C and 3D present heat exchangers in four different working conditions, as a function of the wind, according to embodiments of the present invention.
Figure 3B:
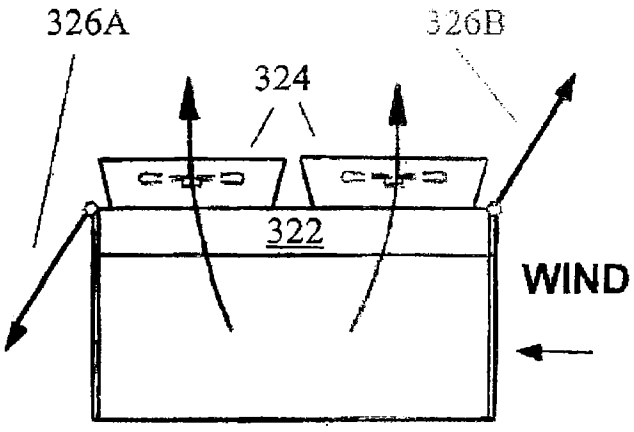
Figure 3C:
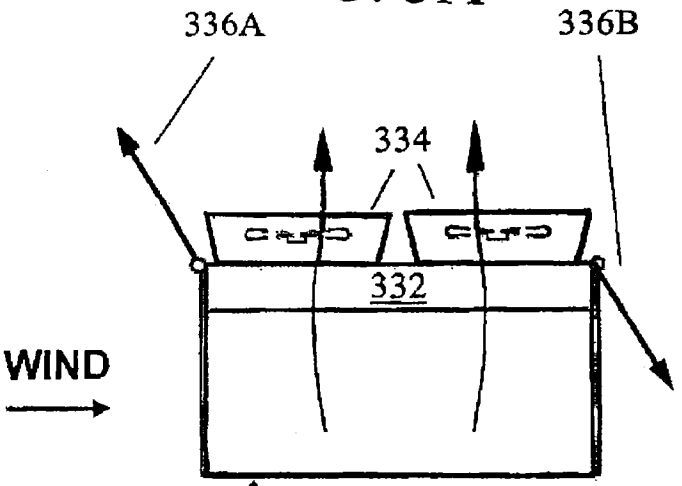
Figure 3D:
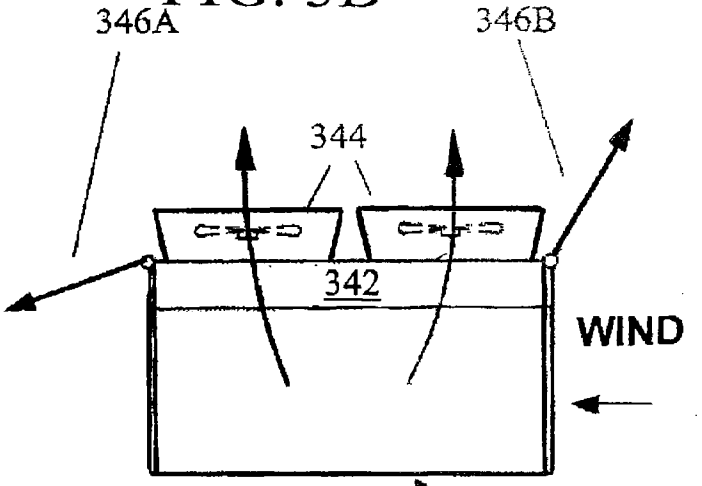

Reference is made now to FIGS. 3A, 3B, 3C and 3D, showing heat exchangers 310, 320, 330 and 340, respectively in four different working conditions, as a function of the wind, according to embodiments of the present invention. FIG. 3A shows heat exchanger 310 in a situation where the wind velocity is zero. At this state, wind deflectors 316A, 326B are raised (angle β is close to 180 degrees), acting as tip back-flow preventers. FIG. 3B shows heat exchanger 310 in a situation where the wind blows from right to left in the drawing. Thus, in such a situation, wind deflector 326A is lowered and wind deflector 326B is raised. FIG. 3C shows heat exchanger 310 in a situation where the wind blows from left to right. Accordingly, wind deflector 336A is raised and wind deflector 336B is lowered. FIG. 3D shows heat exchanger 310 in a situation where the wind blows from right to left at low speed. Accordingly, wind deflector 346A is lowered but to an actual angle β bigger than that of FIG. 3B.

Figure 4:
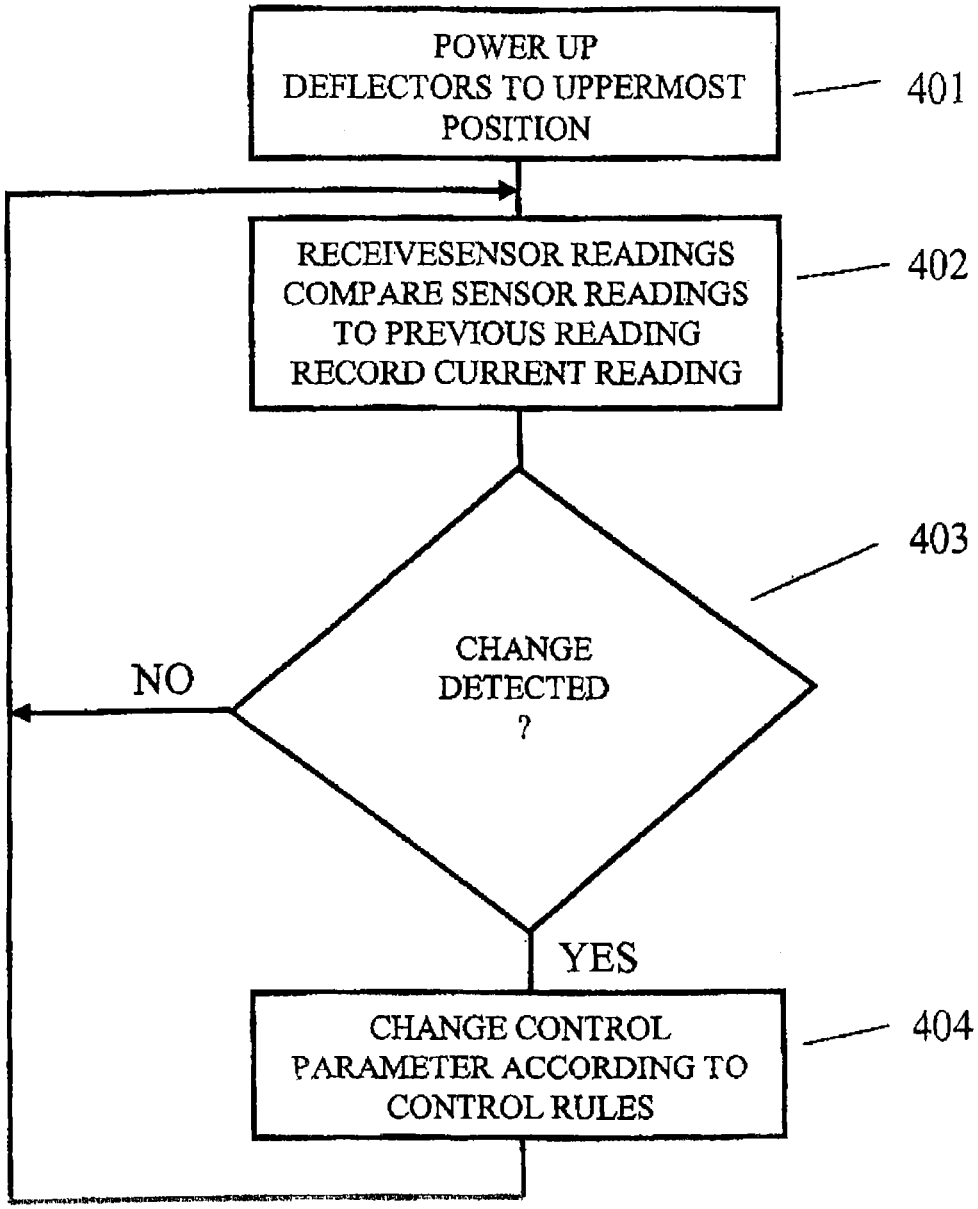
FIG. 4 is a flow diagram presenting a method of operation of a system according to embodiments of the present invention.

Reference is made now to FIG. 4, which is a flow diagram presenting a method of operation of a system, such as system 200 (FIG. 2), according to embodiments of the present invention. A system, such as system 200, for minimizing the undesired effect of wind blowing over a heat exchanger, such as heat exchanger 201, may be set to have its wind deflectors (such as wind deflectors 208) set to an uppermost position when power-up process commences (block 401). The initial angle of the wind deflectors may be set to an angle β other than the uppermost angle, based on accumulated experience at the specific system location and other specific parameters. Once the system is operative, readings from its sensors (such as outlet temperature sensors 210, ambient temperature and wind sensor 212, inlet air pressure sensors 318, etc.) are collected, recorded and compared to previous readings (block 402). When a change in a received reading of a parameter is detected (block 403), the system will carry out a correction command, based, for example, on a set of rules saved in the system (block 404), and will repeat its cycle in block 402. If no change in any parameter, that causes a correction operation, was detected, the system returns to block 402 and repeats its cycle. It will be noted that loop parameters, such as cycle time, and system control parameters, such as "hysteresis band" (to refrain from undesired small corrections), may be set and used, as is known in the art.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A method of minimizing an undesired effect of wind on the operation of a heat exchanger system comprising a generally rectangular arrangement of a plurality of horizontally spaced finned tube arrays, the arrangement having longer sides extending in a length direction and shorter sides extending in a width direction, a plurality of fans provided above the finned tube arrays for inducing air through the finned tube arrays, wherein at least two of said fans are mutually spaced in the width direction, a wind deflector provided adjacent one of the longer sides and pivotally mounted on a horizontally extending pivot axis to be positioned at a pivot angle relative to a vertically downwardly angled position, and at least one sensor of the group comprising an outlet temperature sensor provided at an air outlet of at least one of said fans, and an ambient temperature sensor, wherein the horizontally extending pivot axis is located adjacent to a proximal end of the wind deflector, and the wind deflector extends to a distal end of the wind deflector, which distal end is located opposite the proximal end, wherein the pivot angle is defined as an angle between a vertical line extending upward and through the pivot axis and a line from the pivot axis to the distal end of the wind deflector, and wherein said step of changing the pivot angle of the wind deflector from an initial angle comprises decreasing an angle of the wind deflector, said method comprising the steps of:

setting the pivot angle of the wind deflector to an initial angle from 150° to 180°;

collecting and recording a current reading of at least one of the sensors;

comparing the current reading of the at least one of the sensors to a previous reading of the at least one of the sensors; and changing the pivot angle of the wind deflector from the initial angle when the current reading of the at least one of the sensors is changed from the previous reading, so as to minimize an undesired effect of the wind on an operation of said heat exchanger.

2. The method according to claim 1, wherein the at least one sensor includes an outlet temperature sensor provided at an air outlet of at least one of said fans.

3. The method according to claim 2, further comprising two of said outlet temperature sensors and two of said wind deflectors, each of said wind deflectors being provided adjacent one of said outlet temperature sensors, wherein said step of changing the pivot angle of the wind deflector from an initial angle comprises decreasing an angle of the wind deflector adjacent the one of said outlet temperature sensors having a lower current temperature reading, when a temperature difference between the two outlet temperature sensors in the current temperature reading is greater than a temperature difference of the previous temperature reading.

4. The method according to claim 2, comprising two air pressure sensors and two of said wind deflectors, each of said wind deflectors being provided adjacent one of said air pressure sensors, wherein said step of changing the pivot angle of the wind deflector from an initial angle comprises decreasing an angle of the wind deflector adjacent one of said air pressure sensors whose current air pressure reading is lower than a previous air pressure reading.

5. The method according to claim 1, further comprising wind deflectors provided adjacent both of the longer sides, wherein the at least one sensor includes a wind speed sensor and wherein said step of changing the pivot angle of the wind deflector from an initial angle comprises decreasing a pivot angle of the wind deflector at a side opposite the wind direction when the current wind speed reading is greater than the previous wind speed reading.

6. The method according to claim 5, further comprising not decreasing a pivot angle of the wind deflector at the side of the wind direction.

* * * * *